US006125999A

United States Patent [19]

Slomski

[11] Patent Number: 6,125,999

[45] Date of Patent: Oct. 3, 2000

[54] PANEL CONTAINER CARRIER

[75] Inventor: Edward J. Slomski, Crystal Lake, Ill.

[73] Assignee: Illinois Tool Works Inc., Glenview, Ill.

[21] Appl. No.: 09/198,003

[22] Filed: Nov. 23, 1998

[51] Int. Cl.[7] ..... B65D 71/00

[52] U.S. Cl. ..... 206/150; 206/428

[58] Field of Search ..... 206/145, 147, 206/150, 151, 158, 170, 427, 428

[56] References Cited

U.S. PATENT DOCUMENTS

| | | | |
|---|---|---|---|
| 3,325,004 | 6/1967 | Wanderer . | |
| 3,404,505 | 10/1968 | Hohl et al. . | |
| 3,460,863 | 8/1969 | Schaich . | |
| 3,504,790 | 4/1970 | Owen . | |
| 3,946,862 | 3/1976 | Klygis et al. . | |
| 5,290,083 | 3/1994 | Rissley | 206/150 |
| 5,609,247 | 3/1997 | Appleton | 206/150 |

*Primary Examiner*—Jacob K. Ackun
*Attorney, Agent, or Firm*—Pauley Peterson Kinne & Fejer

[57] ABSTRACT

This invention relates to a package of a plurality of elongated containers unitized with a flexible container carrier. The carrier is constructed from a plastic planar sheet having a plurality of first receiving openings positioned near a first lateral edge of the sheet and a plurality of second receiving openings at a distance from the first receiving openings. Each of the first receiving openings engages with a neck portion of one of the elongated containers and each of the second receiving openings engages with a middle portion of one of the elongated containers. A panel integral with the sheet is positioned on an outer surface of the package between the first receiving openings and the second receiving openings. The dimensions of the panel correspond with the dimensions of the package to create a package having a large promotional area for advertising and product information.

9 Claims, 7 Drawing Sheets

PANEL CONTAINER CARRIER

BACKGROUND OF THE INVENTION

1. Field of the Invention

This invention relates to a container carrier having a plurality of first receiving openings, at least one second receiving opening and a prominent integral panel.

2. Description of Prior Art

Conventional container carriers are often used to unitize a plurality of similarly sized containers, such as cans, bottles, jars and boxes, although other packages or containers may be unitized. Traditionally, bottle and can carriers having a prominent display panel are single-piece paperboard box carriers and not plastic ring carriers.

The plastic ring carrier produces a unitized package for containers using little material. However, when used alone has little or no advertising or promotional printing space. Conversely, the box carrier generally has a relatively large amount of area for promotional graphics. Disadvantageously, the box carrier requires a relatively large amount of material, permits containers to fall out if it is not maintained in an upright position, and usually shrouds much of the actual containers. Therefore, there is a need for a package that incorporates the stability and economy of a ring carrier and the promotional area of a box carrier.

Wanderer, U.S. Pat. No. 3,325,004 and Owen, U.S. Pat. No. 3,504,790 each teach a carrier that is configured to engage a top portion and a bottom portion of each of a plurality of containers. The Owen and Wanderer patents both teach a carrier having a plurality of upper rings and lower rings divided by a handle and by straps, respectively, each upper ring engaging an upper portion of a container and each lower ring engaging a lower portion of a container.

Schaich, U.S. Pat. No. 3,460,863 teaches a tubular length of material having opposing apertures for engaging with containers. The carrier taught by the Schaich patent requires an annular extrusion die or other means of manufacture of a continuous tubular length of material.

SUMMARY OF THE INVENTION

It is one object of this invention to provide a container carrier that unitizes a plurality of containers into a tight, solid package.

It is another object of this invention to provide a container carrier that provides a large panel for merchandising information.

It is still another object of this invention to provide a container carrier which restricts lateral and vertical movement of the containers with respect to one another.

It is another object of this invention to provide a container carrier that maintains material separation between each adjacent container within the package.

It is yet another object of this invention to provide a container carrier that incorporates the stability and economy of a ring carrier and the promotional area of a box carrier.

A carrier according to this invention is preferably used to unitize multiple elongated containers, such as bottles or cans, by engaging a neck portion and a middle portion of the container. The carrier comprises a flexible, resilient planar sheet having a first lateral edge, a second lateral edge and two longitudinal edges.

A plurality of first receiving openings are formed in the sheet near or along a first lateral edge of the sheet. At least one second receiving opening is preferably formed in the sheet at a distance from the first receiving openings. In one preferred embodiment of this invention, the at least one second receiving opening is positioned along a second lateral edge of the sheet.

A panel is formed in the sheet and positioned between the first receiving openings and the at least one second receiving opening. A panel width is approximately equal to a width of the sheet between the longitudinal edges and a panel length is approximately equal to the distance between the first receiving openings and the at least one second receiving opening. A handle is also preferably integrated with the sheet in or adjacent the panel.

According to another preferred embodiment of this invention, the carrier further comprises a plurality of third receiving openings. At least two of the third receiving openings are positioned along the second lateral edge of the sheet and at a second distance from the at least one second receiving opening. A second panel is thereby formed within the second distance between the third receiving openings and the at least one second receiving opening.

The carrier engages a plurality of elongated containers to form a package. Each of the first receiving openings preferably engages with the neck portion of one of the containers and each of the at least one second receiving openings engages with the middle portion of at least one of the containers. The resulting package includes a C-shaped carrier wherein the panel is flat and tight with respect to the containers. The width and height of the panel preferably corresponds with a width and height of the package, resulting in a prominent promotional area on the package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
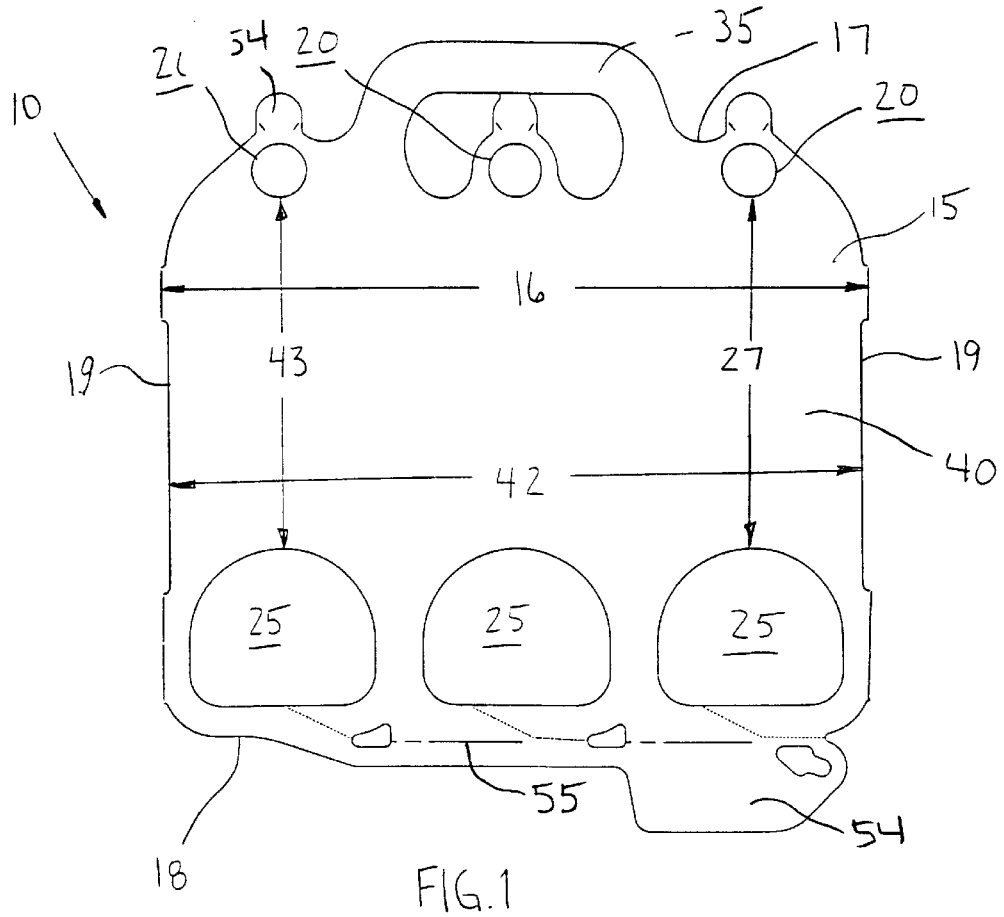
FIG. 1 is a top view of a container carrier according to one preferred embodiment of this invention.

FIGS. 1–12 show carrier 10 for carrying a plurality of containers 5. Containers 5 shown in FIGS. 2, 4, 10 and 12 are preferably bottles or cans. Containers 5 are preferably like-sized within a single carrier 10. In addition, containers 5 preferably comprise a neck or chime portion 7 in an upper section of container 5 and a middle portion 8 defined in approximately a middle one-third of container 5.

Carrier 10 unitizes a plurality of containers 5 to create package 1, such as package 1 shown in FIGS. 2, 4, 10 and 12. Carrier 10 comprises planar sheet 15 having first lateral edge 17, second lateral edge 18 and two longitudinal edges 19. Sheet 15 is preferably constructed from a flexible, resilient material such as plastic. In one preferred embodiment of this invention, sheet 15 is made from low density polyethylene.

Sheet 15 of material is preferably cut, using means known to those skilled in the art, such as a stamping die, to form a plurality of first receiving openings 20 in sheet 15. Preferably, at least two first receiving openings 20 of the plurality of first receiving openings 20 are positioned near first lateral edge 17 of the sheet 15.

Likewise, at least one second receiving opening 25 is preferably formed in sheet 15 at distance 27 from first receiving openings 20. In one preferred embodiment of this invention, second receiving openings 25 are positioned along second lateral edge 18 of sheet 15.

Panel 40 is preferably formed in sheet 15 and positioned between first receiving openings 20 and the at least one second receiving opening 25. In one preferred embodiment of this invention, panel 40 has panel width 42 approximately corresponding to a width 16 of sheet 15 between longitudinal edges 19. Preferably, panel length 43 approximately corresponds to distance 27 between first receiving openings 20 and the at least one second receiving opening 25.

Panel 40 preferably accommodates, on one or both sides, UPC and proof of purchase labels, graphics, and promotional and/or other information related to the package 1 contents and/or ingredients. Panel 40 is preferably generally continuous and unbroken, without cutouts or apertures, throughout its defined area.

In one preferred embodiment of this invention, carrier 10 further comprises line of perforation 50 dividing panel 40 from second receiving openings 25. Line of perforation 50 may be formed with a series of slits through sheet 15 or a reduced thickness of sheet 15. Preferably, carrier 10 folds along line of perforation 50. In one preferred embodiment of this invention shown in FIGS. 11 and 12, line of perforation 50 divides the plurality of first receiving openings 20 from panel 40.

According to one preferred embodiment of this invention, carrier 10 further comprises handle 35 integrated with sheet 15. Preferably, handle 35 is integrated between panel 40 and first receiving openings 20. In another preferred embodiment of this invention shown in FIG. 11, handle 35 is integrated between first receiving openings 20.

Figure 6:
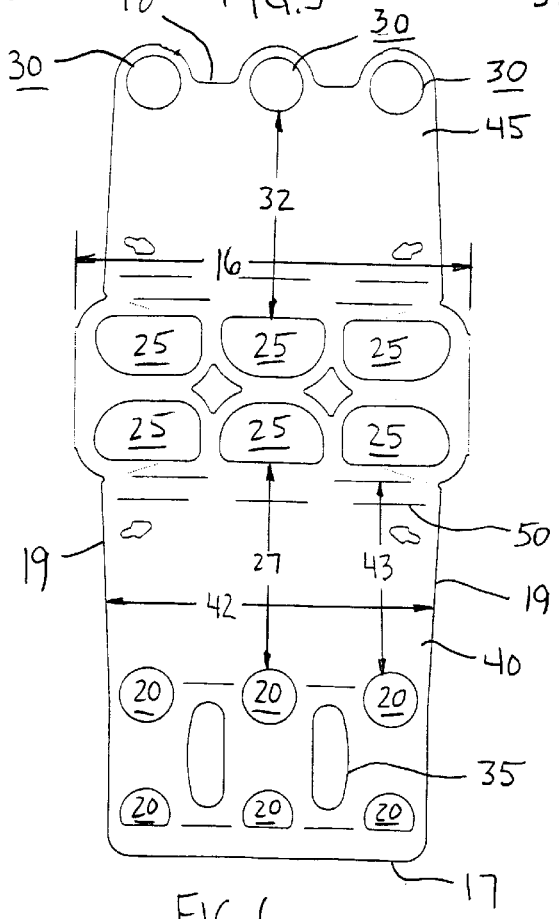
FIG. 6 is a top view of a container carrier according to yet another preferred embodiment of this invention.

As shown in FIG. 6, according to another preferred embodiment of this invention, carrier 10 further comprises a plurality of third receiving openings 30. Preferably, at least two third receiving openings 30 of the plurality of third receiving openings 30 are positioned along second lateral edge 18 of sheet 15. Third receiving openings 30 are preferably positioned at second distance 32 from second receiving openings 25.

According to a preferred embodiment of this invention having a plurality of third receiving openings 30, carrier 10 further comprises second panel 45 positioned between third receiving openings 30 and second receiving openings 25. Like panel 40, second panel 45 may provide additional promotional area on package 1.

Carrier 10 as described above is configured to engage a plurality of elongated containers 5, resulting in package 1. Package 1 preferably includes two or more containers 5. In one preferred embodiment of this invention shown FIG. 2, package 1 includes three bottles; in another preferred embodiment of this invention shown in FIG. 4, package 1 includes six bottles; in still another preferred embodiment of this invention shown in FIG. 10, package 1 includes two bottles; and in yet another preferred embodiment of this invention, package 1 includes six cans. Carrier 10 may be manufactured to hold any combination of two or more containers 5.

As shown in FIGS. 2, 4, 10 and 12, each of first receiving openings 20 is preferably engaged with neck portion or chime 7 of one of containers 5. Preferably, first receiving opening 20 slides over neck portion 7 of container 5 and an area of sheet 15 surrounding first receiving opening 20 engages with chime 9, cap 6 or similar area of container 5.

Figure 2:
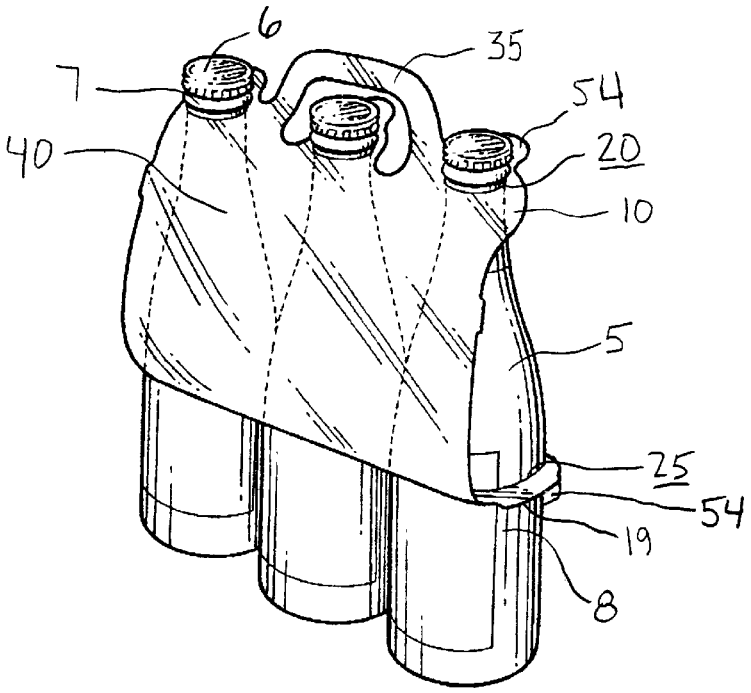
FIG. 2 is a perspective view of a package of containers using the container carrier shown is FIG. 1.
Figure 3:
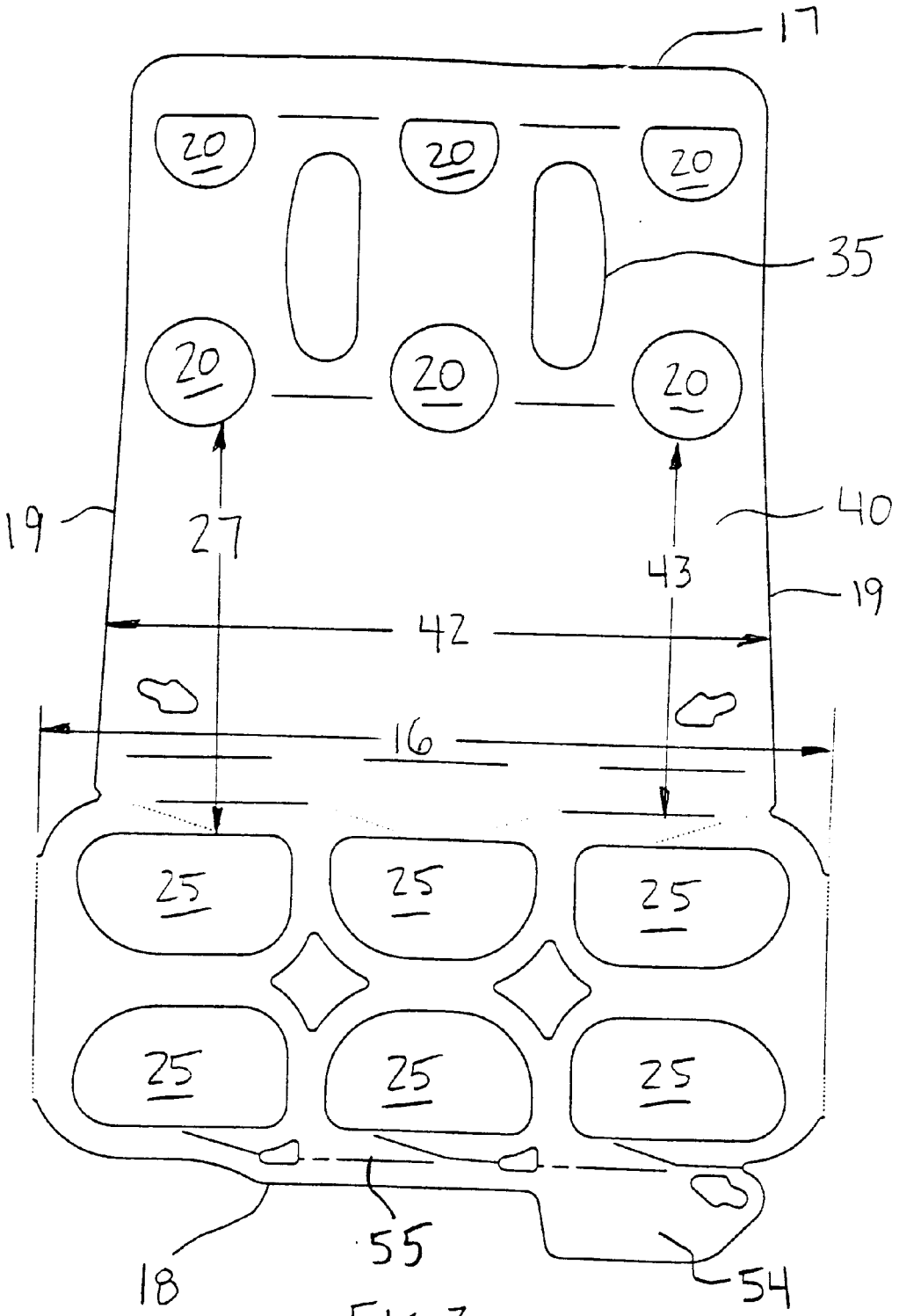
FIG. 3 is a top view of a container carrier according to another preferred embodiment of this invention.
Figure 4:
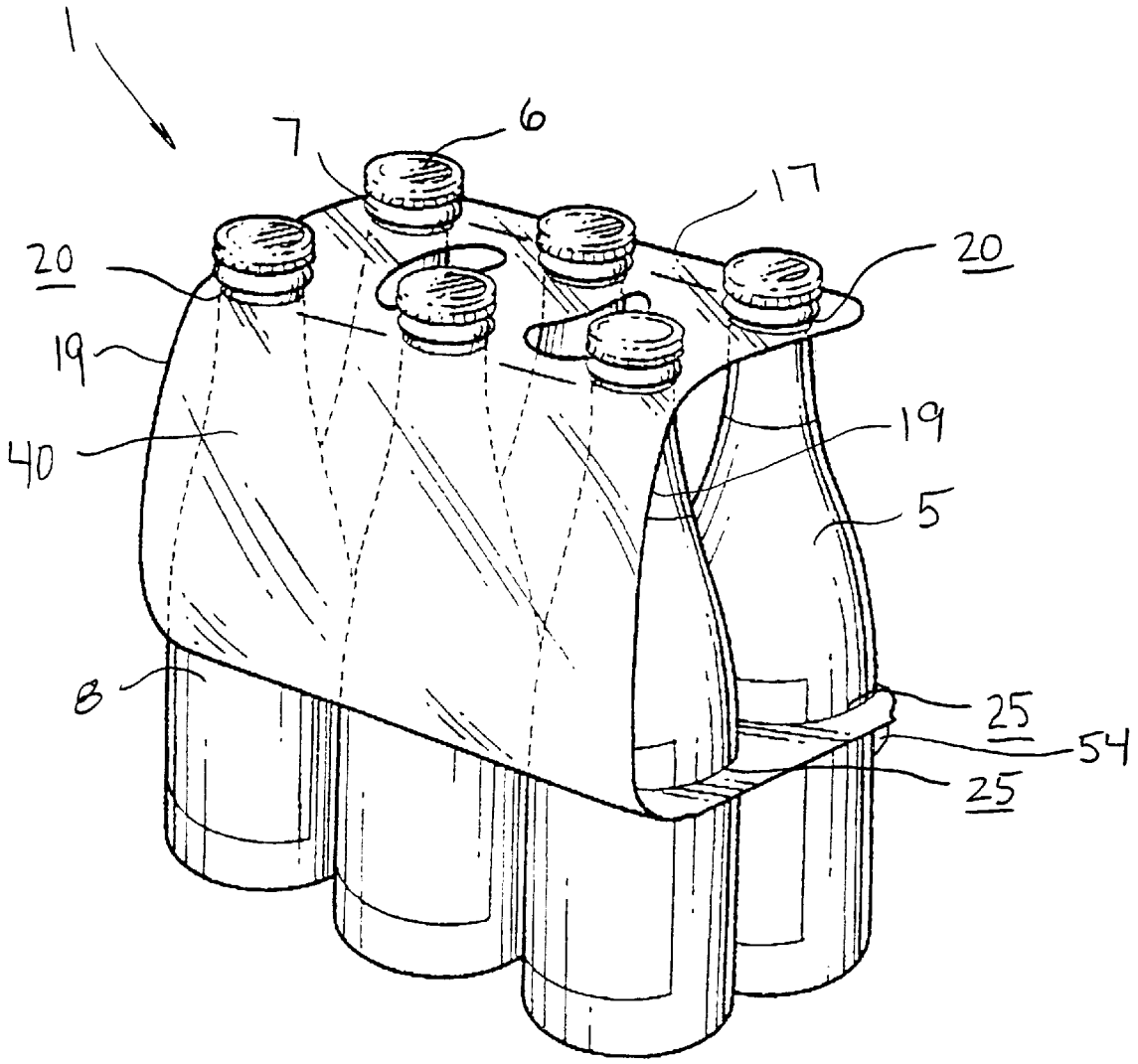
FIG. 4 is a perspective view of a package of containers using the container carrier shown in FIG. 3.
Figure 10:
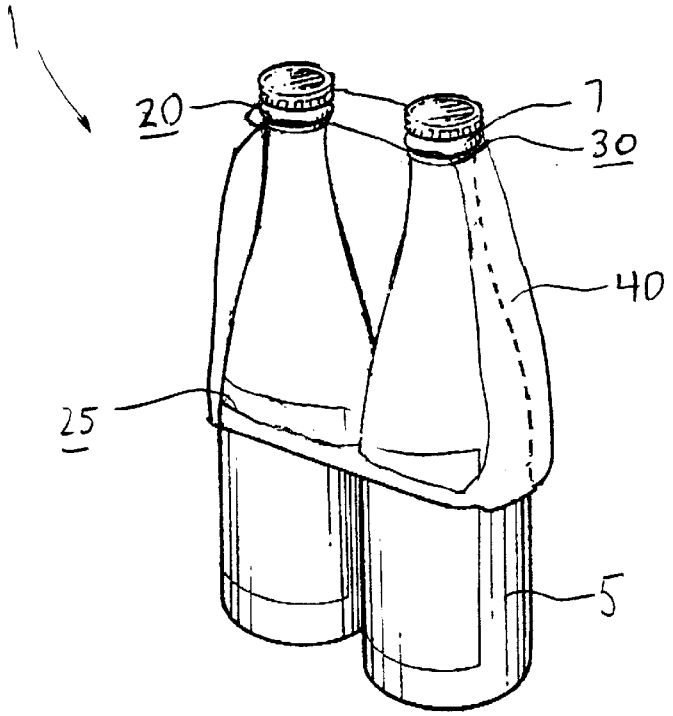
FIG. 10 is a perspective view of a package of containers using the container carrier shown in FIG. 9.

As further shown in FIGS. 2, 4 and 10, each of second receiving openings 25 engages with middle portion 8 of one of containers 5. In this preferred embodiment containers 5 are preferably bottles. Preferably, middle portion 8 comprises an approximate middle third of a length of container 5. Preferably, a diameter of middle portion 8 of container 5 is larger than a diameter of second receiving opening 25 thus resulting in a stretched engagement of carrier 10 with container 5.

Figure 12:
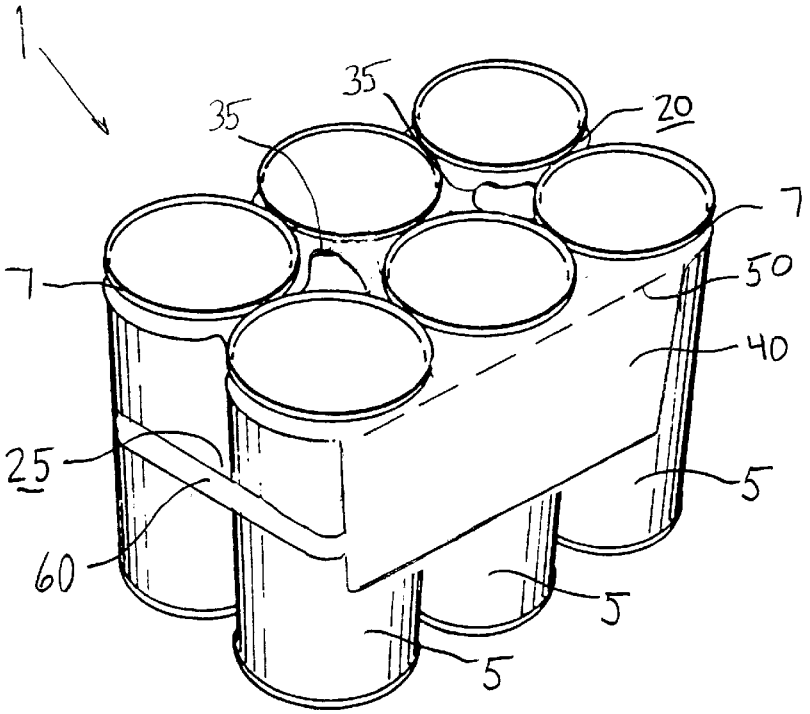
FIG. 12 is a perspective view of a package of containers using the container carrier shown in FIG. 11.

In another preferred embodiment of this invention shown in FIG. 12, second container receiving opening 25 engages with middle portion 8 of each container 5. In this preferred embodiment, containers 5 are preferably cans. Such a single container receiving opening 25 is preferably formed by center band 60. In one preferred embodiment of this invention, center band 60 includes pull tab 54 for facilitating access to containers 5 in package 1.

Figure 5:
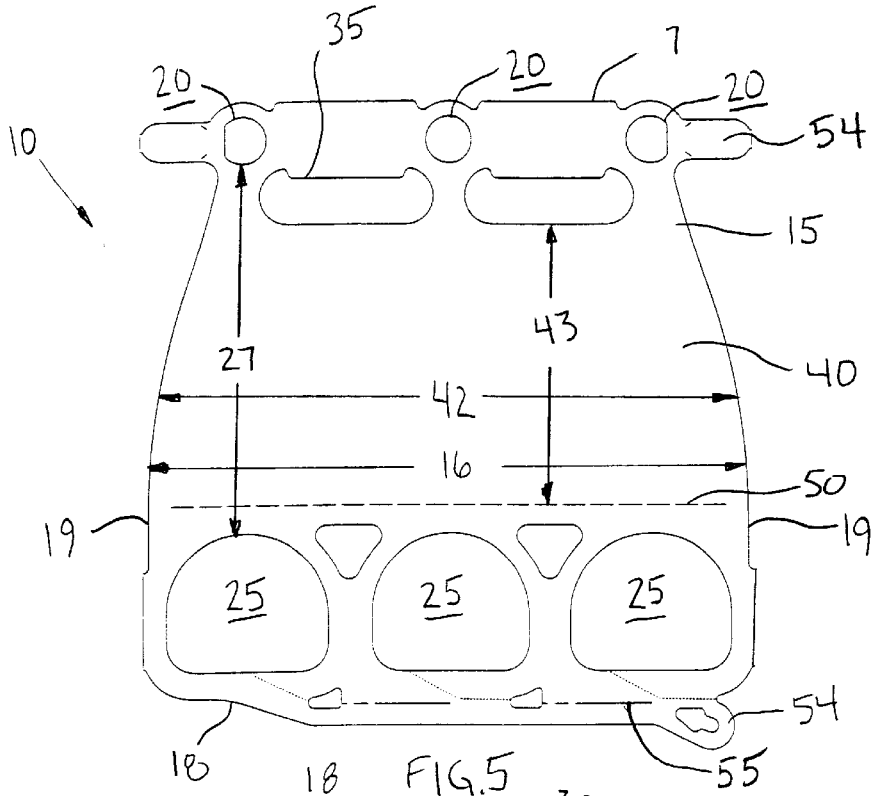
FIG. 5 is a top view of a container carrier according to another preferred embodiment of this invention.
Figure 7:
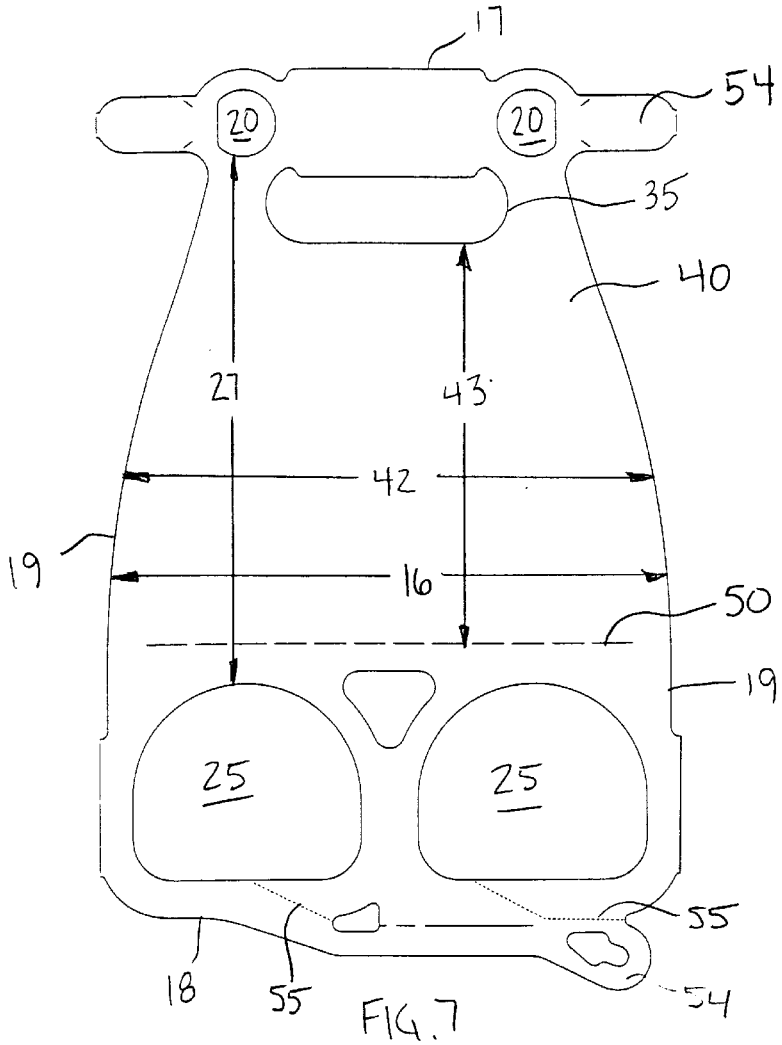
FIG. 7 is a top view of a container carrier according to yet another preferred embodiment of this invention.
Figure 8:
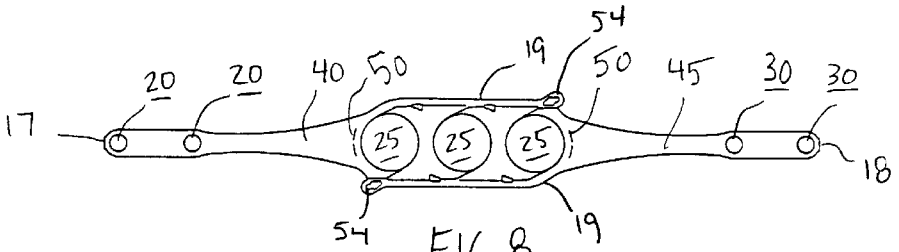
FIG. 8 is a top view of a container carrier according to another preferred embodiment of this invention.
Figure 9:
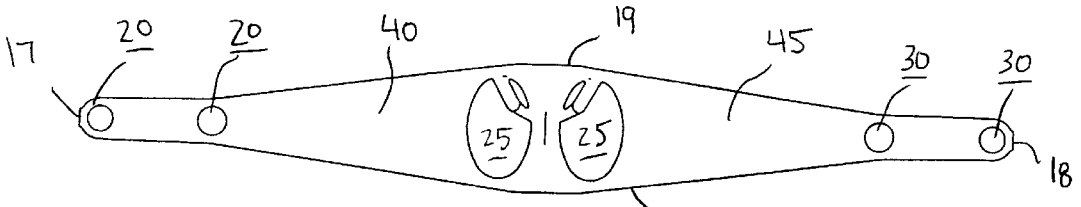
FIG. 9 is a top view of a container carrier according to another preferred embodiment of this invention.
Figure 11:
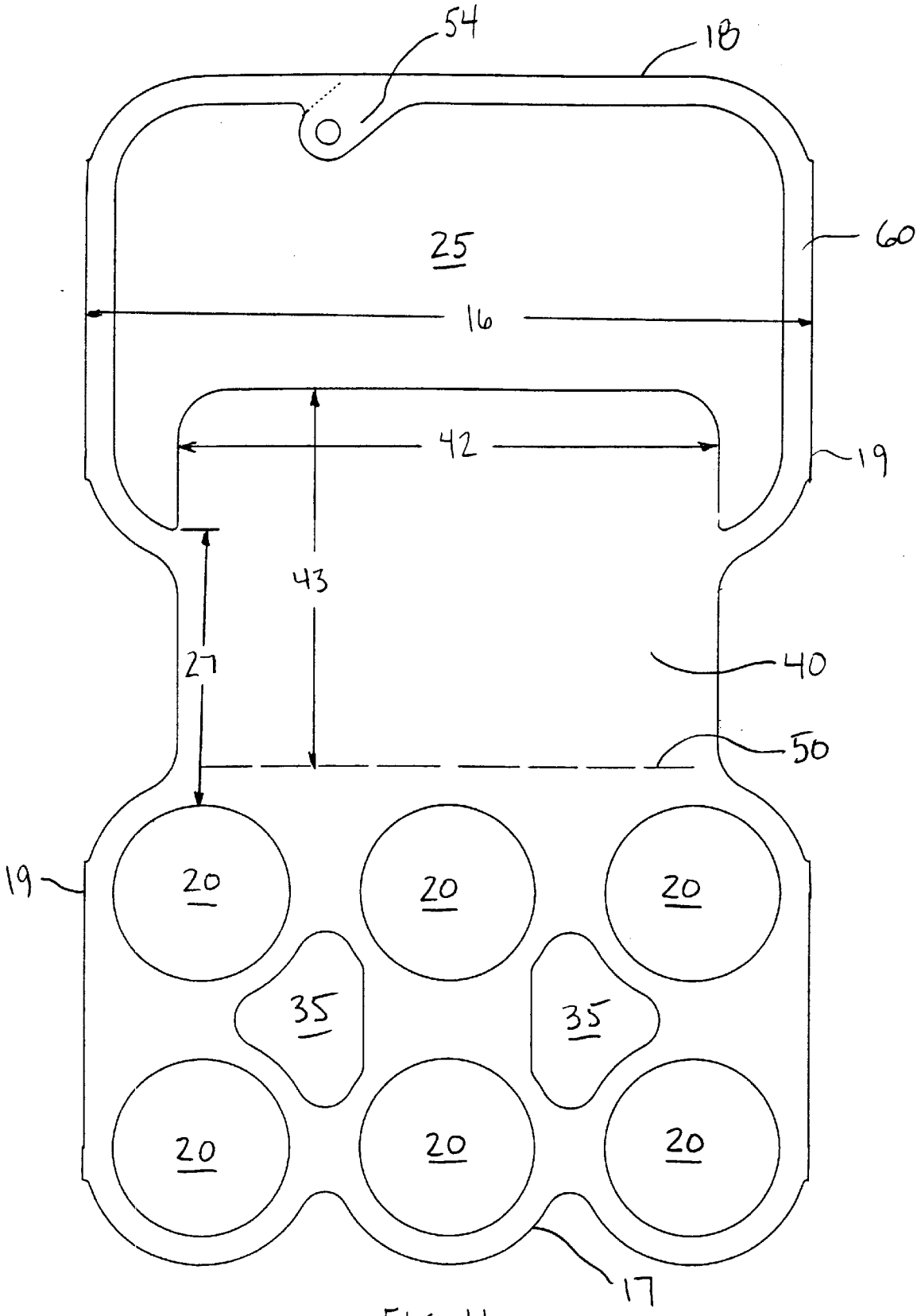
FIG. 11 is a top view of a container carrier according to yet another preferred embodiment of this invention.

As a result of the above-described engagement with containers 5, a profile of carrier 10 is preferably a C-shaped curve with respect to containers 5. Preferably, carrier 10 bends sharply along line of perforation 50 adjacent second receiving openings 25 as shown in FIGS. 2, 4 and 10, or first receiving openings 20 as shown in FIG. 11. Panel 40 is preferably flat and tight with respect to containers 5 resulting in a prominent and visible display or billboard area. Panel width 42 between longitudinal edges 19 of sheet 15 preferably corresponds with a width of package 1. In one preferred embodiment of this invention, panel width 42 tapers inward toward first receiving openings 20 as shown in FIGS. 5 and 7.

Additionally, as a result of the above-described engagement with containers 5, carrier 10 provides and maintains material separation between each adjacent container 5 within package 1. Such material separation is important to protect containers 5 such as glass bottles, from breakage or abrasion. Such material separation is less important when containers 5 are cans, thus the preferred embodiment of this invention shown in FIGS. 11 and 12 does not require such material separation.

In a preferred embodiment of this invention having third receiving openings 30, carrier 10 engages with containers 5 as described above, however, in addition, third receiving openings 30 also engage neck portion 7 of containers 5. Each third receiving opening 30 preferably overlaps one first receiving opening 20 and engages with neck portion 7 of one container 5.

In the preferred embodiment of this invention having third receiving openings 30, carrier 10 preferably further comprises second panel 45 positioned between third receiving openings 30 and second receiving openings 25. Second panel 45 is preferably located on an opposite side of package 1 as panel 40. In this manner, package is bounded on two sides by panels 40, 45 resulting in longitudinal coverage of package 1 by carrier 10.

In one preferred embodiment of this invention, shown in FIG. 6, carrier 10 comprises twice as many first receiving openings 20 as third receiving openings 30. Third receiving openings 30 shown in FIG. 6 only engage with a single row of containers 5, thereby reducing material required to manufacture carrier 10 but still resulting in a sturdy package with two panels 40, 45 for product display.

As shown in the Figures, various means of removal of containers 5, such as pull tabs 54 or perforated removal strips 55 may be integrated with respect to carrier 10, including within panel 40. Such means of removal assist the consumer in removing tightly engaged containers 5 from carrier 10.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A package of a plurality of elongated containers, the package comprising:

a planar sheet of a plastic material, the sheet having a plurality of first receiving openings each positioned near a first lateral edge of the sheet and at least one second receiving opening at a distance from the first receiving openings;

each of the first receiving openings engaged with a neck portion of one of the elongated containers;

each of the at least one second receiving openings engaged with a middle portion of at least one of the elongated containers;

a panel of the sheet positioned on an outer surface of the elongated containers between the first receiving openings and the at least one second receiving opening, the panel having a panel width corresponding with a width of the package between longitudinal edges of the sheet and a panel length corresponding with the distance between the first receiving openings and the at least one second receiving opening.

2. The carrier of claim 1 further comprising a line of perforation dividing the panel from the at least one second receiving opening.

3. The carrier of claim 1 further comprising a handle integrated in the sheet between the panel and the first receiving openings.

4. The carrier of claim 1 wherein the at least one second receiving opening is positioned along a second lateral edge of the sheet.

5. The carrier of claim 1 further comprising a plurality of third receiving openings along a second edge of the sheet, the third receiving openings at a second distance from the at least one second receiving opening.

6. The carrier of claim 5 further comprising a second panel positioned between the third receiving openings and the at least one second receiving opening.

7. The carrier of claim 5 wherein each of the third receiving openings engage with the neck portion of one of the elongated containers.

8. The carrier of claim 5 comprising twice as many first receiving openings as third receiving openings.

9. The carrier of claim 5 wherein each third receiving opening overlaps one first receiving opening and engages with the neck portion of one of the elongated containers.

* * * * *